United States Patent [19]

Gundersen

[11] 4,030,272

[45] June 21, 1977

[54] MEANS ON PACKING MACHINE

[75] Inventor: Marius Gundersen, Larvik, Norway

[73] Assignee: Vefi A/S, Norway

[22] Filed: May 19, 1976

[21] Appl. No.: 687,857

[30] Foreign Application Priority Data

May 28, 1975 Norway ..... 1890/75

[52] U.S. Cl. ..... 53/376

[51] Int. Cl.[2] ..... B65B 7/26

[58] Field of Search ..... 53/376, 377

[56] References Cited

UNITED STATES PATENTS

| | | | |
|---|---|---|---|
| 3,457,701 | 7/1969 | Wainberg | 53/376 |
| 3,877,205 | 4/1975 | Gundersen | 53/376 |

*Primary Examiner*—Travis S. McGehee

*Attorney, Agent, or Firm*—Ladas, Parry, Von Gehr, Goldsmith & Deschamps

[57] ABSTRACT

A means on a packing machine for closing containers with lids provided with complementary press-button snap-lock means, of the kind whereby the containers are advanced one after one on a conveyor belt or the like. Above said belt is arranged a rotor wheel provided with compression means for successive locking of said press-button means during the passage of the container on the belt. The compression means is pivotably suspended in the rotor wheel about a transverse axis parallel with the rotor wheel axis operative to that said compression means may pivot relative to the wheel and thereby be subjected to positional adjustment relative to the press-button means prior to and during the locking operation of same.

3 Claims, 7 Drawing Figures

MEANS ON PACKING MACHINE

The present invention relates to a means or implement on a packing machine for packing goods into plastics containers and the like provided with hinged covers or lids, the lid at the closing being attached to the container by means of complementary pressbutton-like locking elements provided along the container edge and the lid edge, respectively. Such containers have in more recent years come into broad usage in connection with packing and marketing, among other things of food products, such as tomatoes, fruits, eggs, etc.

A relatively simple packing machine used for packing goods in such containers consists of a packing table including a horizontally extending conveyor belt, at the beginning of which there is positioned a magazine or supply of containers whereby the containers may be fed, one after the other, onto the moving belt. The filling of the containers usually takes place manually while the containers are moving along the belt in an open position. When the containers have been filled upon approaching the outlet end of the conveyor belt, the containers are closed and preferably locked together before further handling and transport.

The closing and the locking of the containers by means of the press-button elements constitute, due to the special characteristics of the containers and the locking element, a relatively cumbersome and time consuming operation.

The applicants have priorily developed a mechanically simple, but nevertheless effective apparatus for continuous closing and locking of such containers, while being advanced on a conveyor belt or the like, in filled state. It is referred to Norwegian Pat. No. 129,732. In accordance with the patent, the locking of the press-button elements is carried out by means of a rotor wheel positioned above the conveyor belt and being provided with a plurality of circumferentially spaced, radially extending spoke members, the lower parts of which follow a circle extending down into the path of movement of the containers advanced on the belt, effecting that when each separate container reaches said rotor wheel, the container pushes a first spoke on the rotor wheel forwardly, whereby the subsequent spoke on the wheel is pivoted downwardly into contact with the lid on the container into register with the press-button elements and effecting compression and mutual locking together of the complementary press-button elements on the container and on the lid, respectively.

Although the machine in accordance with the applicant's prior patent functions satisfactorily, the tendency in the packing industry, among other factors due to costs problems, goes toward using steadily thinner and therefore more fragile sheet material in the containers. The thinner the sheeting, the more difficult it is to handle the material by means of mechanical implements. A special problem arises in connection with the locking of the press-button elements is the difficulty to obtain accurate foolproof positioning of the compression tool into the complementary press-button elements to be interlocked thereby. Experience has shown that only very small departures from exact positioning of the compression tool, variations in the sheeting material, etc. very often result in that the container is damaged, or result in that the aimed interlocking of the press-button elements is not obtained.

The main object of the present invention is therefore to provide a solution of these problems, and the means in accordance with the invention is characterized in that the compression tool is loosely but limited pivotably journalled on the rotor wheel about a transverse axis parallel with the rotor wheel axis such that the compression tool may pivot by gravity and thereby angularly position itself relative to the container during the interval of mutual contact therebetween.

The press-button elements are usually circular and the compression tool is likewise circular to fit into the press-button element in the lid.

In a preferred embodiment of the invention is on the compression tool resiliently biased a collar or contact socket which serves to contact the container material in a zone around the press-button element prior to or during the interlocking operation operative to obtain an initial fixation of the press-button elements and also to obtain a distribution of the prevailing stresses in the container material.

A preferred embodiment for a means in accordance with the invention shall be further described with reference to the accompanying drawing, wherein.

Figure 1:
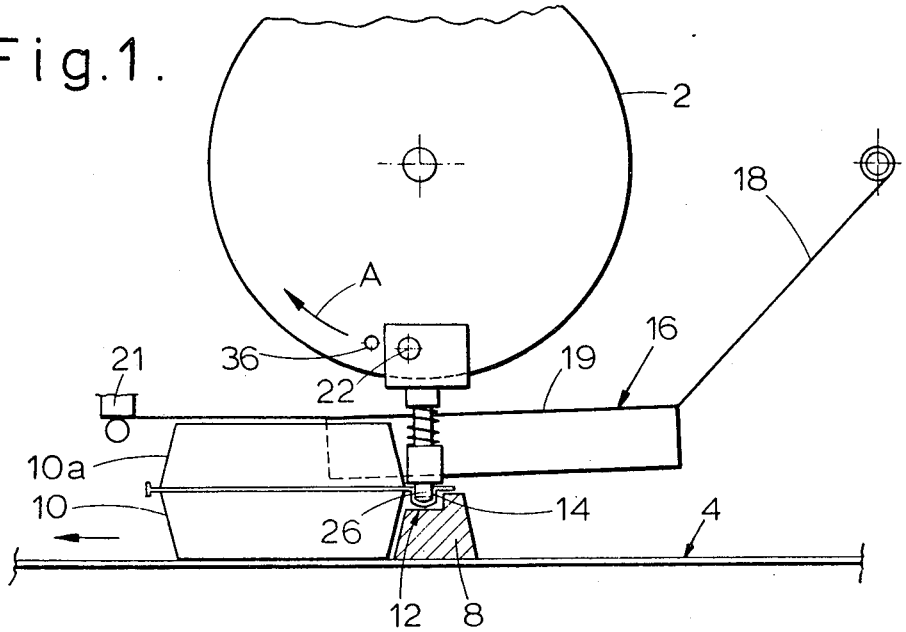
FIG. 1 is showing a schematic lateral view of a part of a packing machine embodying the invention.
Figure 2:
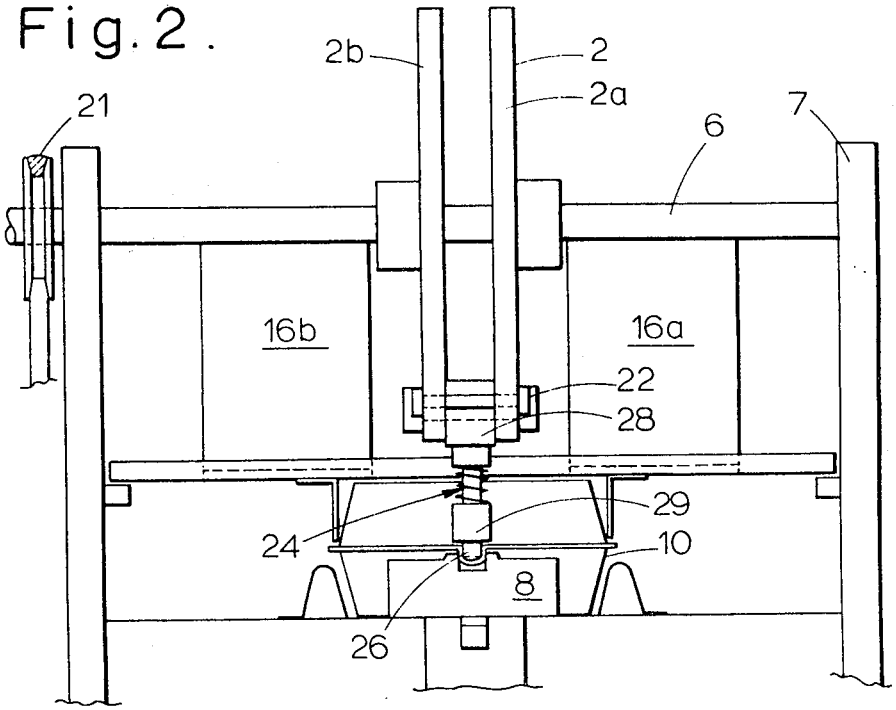
FIG. 2 is showing a cross-sectional view seen along the plane II—II shown in FIG. 1.

In FIGS. 1 and 2 the number 2 designates the rotor wheel which is rotatably journalled on a support shaft 6 in a frame 7 located above the conveyor belt 4 in the packing machine. Evenly spaced along the conveyor belt 4 is located identical container support cleats 8 which are configurated to support the edge portion on each separate container 10 such that the cleat forms an anvil 12 biased against the underside of the press-button element 14 on the container. The apparatus further includes a cover shield means 16 including a tilted part 18 effecting pivoting of the container lid from open to closed position and a horizontal part 19 guiding each container during the passage below the rotor wheel. When the lid is in turned-down position the press-button element in the lid 10a whould be in contact or register with the complementary press-button element in the container 10. The beforementioned described part of the machine can be assumed known.

In the rotor wheel 2 is loosely or freely pivotably journalled on a transverse tap shaft 22 a compression piston means 24.

The compression piston means is mounted in a relatively heavy boss 28 having an aperture for positioning the tap shaft 22. As best appears from FIG. 2 the rotor wheel 2 comprises two mutually spaced parts 2a and 2b provided with a sturdy lateral guide for the boss 28 carrying the compression means.

Figure 3:
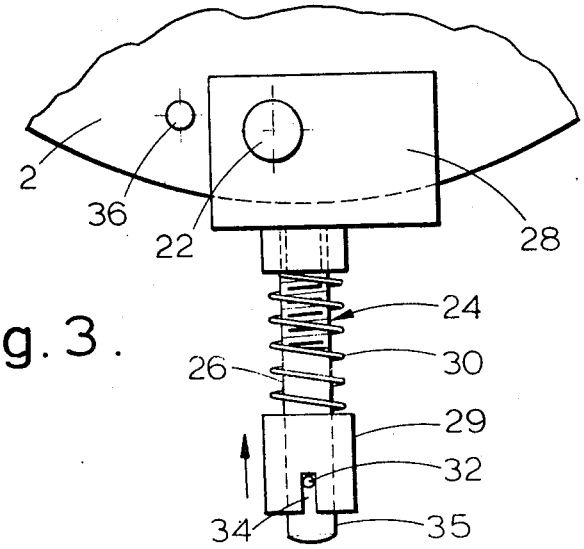
FIG. 3 is a detail view shown in an enlarged scale and which further illustrates the construction of the compression tool, and FIG. 4 a-d are detail views illustrating different phases during the closing operation.

As best appears from FIG. 3 showing the compression means 24 in an enlarged scale, is on a compression or plunger rod 26 journalled a collar or open socket 29 which in the preferred shown embodiment of the invention is resiliently journalled on said rod by means of a helical spring feather maintaining the socket biased against a bias pin 32, which is guided in two oppositely located slits 34 in said socket, such that same is kept not rotatably but displaceably journalled along said rod 26. The length of a protruding end portion 35 of the plunger rod is accurately calibrated to the depth of the press-button elements in said container part.

In the rotor wheel 2 is mounted a limit stop 36 for the pivotable plunger rod. The location of the limit stop 36 in the rotor wheel is accurately defined such that the compression means is freely pivotable between limits during the locking operation but will by gravity otherwise rest against the limit stop in the one or the other end position. This shall be further explained with reference to the detail figures 4 *a–d* which are illustrating four phases during the locking operation of said press-button elements.

The movements of the rotor wheel and the conveyor belt are operationally interconnected via an adjustable belt drive or the like, indicated at the reference number 21 in FIG. 2. The machine is otherwise of known type and constitutes no part of the invention and should therefore be unnecessary to show or describe in detail. The operation must however be arranged such that the position of the rotor wheel can be adjusted accurately relative to the cleats 8 mounted on the belt.

Figure 4A:
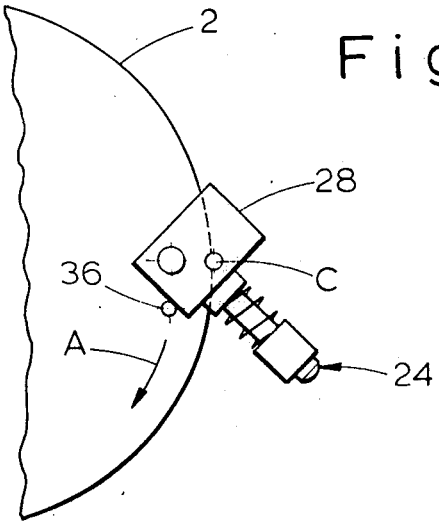
Figure 4B:
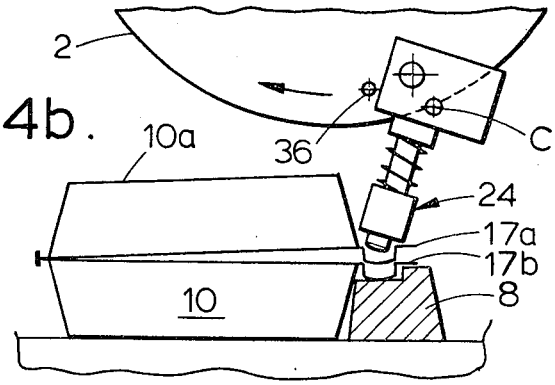
Figure 4C:
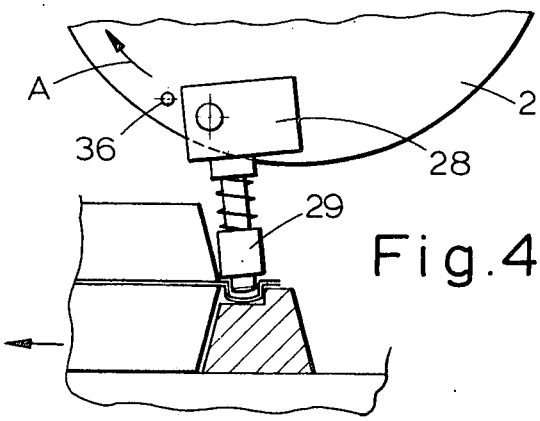
Figure 4D:
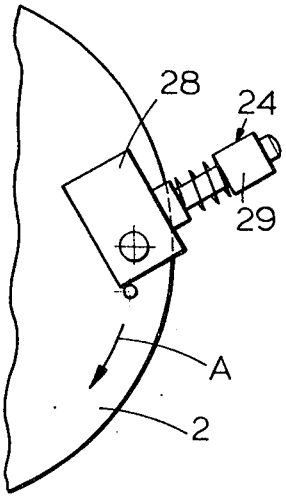

The device in accordance with the invention operates in the following manner:

In FIG. 4*a* the rotor wheel 2 is moving in the direction designated with the arrow A. In the shown angular position for the wheel the compression member 24 — the centre of gravity C of which is positioned approximately at the shown cross ring C in the boss 28 — will swing or fall down by gravity to the right such that said boss 28 comes into rest against the limit stop 36. The compression member moves in this position downwards towards the belt immobile relative to the wheel. In the position shown in FIG. 4*b* the compression member is shown in exactly that angular position where it shall come into registry or contact with the below adjacently positioned press-button element 17*a* in the lid which in this position is loosely resting against the complementary press-button element 17*b* in the container 10. The compression member 24 is in this position due to the selected location of its centre of gravity C here pivoted somewhat "backwards" free of the limit stop 36 and is thus in the shown position freely suspended and the plunger rod 26 is pointing somewhat forward during the registry with the press-button element 17*a* in the container lid 10*a*. During the further advancement of the rotor wheel and the container positioned on the conveyor belt, the plunger rod will move progressively closer to the belt and hereby press said locking element in the lid down into a snap fashioned engagement with the complementary locking element in the container. As a consequence of the fact that the plunger rod during this operation can pivot freely in the direction of movement of the container it will positionally adjust itself versus prevailing variations in the goods occuring in the press-button element means, etc. During the further advancement of the container during the locking operation, the plunger will pivot somewhat in direction backwards and hereby automatically compensate variations between the circular arc movement of the rotor wheel and the linear movement of the container. The detail view 4*c* illustrates the situation when the locking operation is completed. The plunger rod will during the release from the press-button elements pivot somewhat in direction forwards and hereby immediately be additionally pivoted forwardly due to the position of its centre of gravity. During the further rotation of the rotor wheel the compression means will move upward simultaneously as the boss 28 comes into rest against the limit stop 36. This resting position constitutes therefore the other end position relative to the position shown in FIG. 4*a*. When the compression means 24 is passing the top position of the rotor wheel (in other words the upper dead motion point), the compression means will anew undertake a pivot movement and will fall over down to the biasing position as shown in FIG. 4*a*.

During the locking operation itself the lower edge of said socket 29 will clamp against the container goods around the press-button elements and hereby serve two important functions, namely firstly to distribute prevailing stresses in the goods, and secondly to form a fixation member during the final snapping together of the press-button elements.

In the Figures only one compression means on the rotor wheel is shown. In practice one may in some cases locate two or several such means along the circumference of the rotor wheel, and in one and the same angular position one may arrange two or several laterally arranged plunger means for carrying out simultaneous together-snapping of lids and containers provided with two or several press-buttons along one or both side edges. It will furthermore be understood that the means in accordance with the invention can be adapted other types of containers, for instance containers having not hinged, but loose lids, for instance provided with one or several press-button elements along opposite side edges.

I claim:

1. An apparatus for closing containers with lids provided with complementary press-buttons snap-lock means which operates in connection with a packing machine including a conveyor belt for advancing the containers one after the other therethrough comprising a rotor wheel located above said conveyor belt, compression means located on said rotor wheel to successively press together and lock said press-button means during the successive passage of the containers on said belt, said compression means being pivotably suspended from said rotor wheel at the circumference thereof whereby said compression means will undergo angular pivotal movement to facilitate accommodation relative to the press-button means on the container due to the action of gravity, said compression means including a plunger rod means dimensioned to fit into the press-button means, said rod means being surrounded by a tube-like socket whereby the front surface of said socket comes into biasing engagement with the container surrounding the press-button means prior to the locking of the press-button means by the plunger rod means.

2. An apparatus in accordance with claim 1, wherein said socket is spring biased whereby it will undergo a yielding movement during the press-button locking operation.

3. An apparatus in accordance with claim 1, wherein said rotor wheel has located therein a limit stop means which may engage said compression means during the rotation of the rotor wheel.

* * * * *